US005501417A

United States Patent [19]

Capan

[11] Patent Number: 5,501,417

[45] Date of Patent: Mar. 26, 1996

[54] NOISE CANCELLATION IN RAILWAY CAB SIGNAL

[75] Inventor: Ronald R. Capan, Pittsburgh, Pa.

[73] Assignee: Union Switch & Signal Inc., Pittsburgh, Pa.

[21] Appl. No.: 393,115

[22] Filed: Feb. 21, 1995

Related U.S. Application Data

[63] Continuation-in-part of Ser. No. 275,991, Jul. 15, 1994.

[51] Int. Cl.[6] ..... B61L 1/00

[52] U.S. Cl. ..... 246/63 R; 246/194; 246/196

[58] Field of Search ..... 246/1 C, 8, 63 R, 246/63 C, 63 A, 29, 34 R, 28 K, 175, 194, 196; 340/933, 941

[56] References Cited

U.S. PATENT DOCUMENTS

| | | | |
|---|---|---|---|
| 1,328,865 | 1/1920 | Woodward | 246/63 R |
| 1,824,145 | 9/1931 | Howe | 246/63 A |
| 2,000,266 | 5/1935 | Espenschied | 246/63 A |
| 2,064,641 | 12/1936 | Bossart | 246/63 R |
| 2,067,116 | 1/1937 | Brown | 246/63 A |
| 3,201,583 | 8/1965 | Rolle | 246/63 R |
| 3,840,737 | 10/1974 | Hoyler | 246/63 R |
| 4,274,611 | 6/1981 | Salmon | 246/63 R |
| 4,487,385 | 12/1984 | Salmon | 246/63 R |
| 4,720,067 | 1/1988 | Jaeger | 246/63 R |
| 5,263,670 | 11/1993 | Colbaugh et al. | 246/63 R |

*Primary Examiner*—Mark T. Le
*Attorney, Agent, or Firm*—Buchanan Ingersoll

[57] ABSTRACT

A cab signaling apparatus for use on board a railway vehicle which is propelled on rail tracks by an electric drive motor. The invention utilizes a cab signal transmitted to the vehicle through a track circuit in the rails. On board receiving of the cab signal is done by a receiving coil, which may be mounted in front of the lead axle, as a current transformer around the lead axle, or at another location where the cab signal current is relatively strong. The cab signal that is sensed has a cab signal component and an interference component. On board the vehicle a sampled signal is taken which has the characteristic of the electromagnetic interference subjected to the cab signal receiver coil. The sampled signal is then subtracted from the sensed cab signal such that the sampled interference signal cancels the interference component of the cab signal. Embodiments include placing the sampling device as an inductive coil behind the lead axle and in other embodiments in front of the lead axle above the cab signal sensing coil. In some embodiments the noise sampling coil is at 90 degrees to the cab signal receiving coil. A series arrangement with selective polarity on the coils permits a vital arrangement. In some embodiments the sampling to achieve a sampled signal characteristic of electromagnetic interference is done by using a current transformer coil on the electric drive motor cable.

20 Claims, 7 Drawing Sheets

NOISE CANCELLATION IN RAILWAY CAB SIGNAL

RELATED APPLICATION

This is a continuation-in-part of U.S. application Ser. No. 08/275,991, filed Jul. 15, 1994 now pending.

BACKGROUND OF THE INVENTION

In railway transportation systems it is often desirable to transmit information to a rail vehicle by the use of cab signaling. The information desired to be transmitted is encoded into a cab signal current which is transmitted to the vehicle through the rails. When the cab signaling current reaches the vehicle, the signal information may be detected and the information utilized by the vehicle. Some of the information transmitted may be of a nature that is desirable to be known by those on board the vehicle, and may be information that is redundant with wayside signaling information. However, in some instances it may be desirable that the cab signaling information transmits data to the vehicle which is vital to the operation of the vehicle, such as speed commands, and track conditions which effect the operation of the vehicle. This information can be received by the vehicle through an antenna usually positioned in front of the lead axle which inductively couples to the cab signal current which is in the rail in front of the lead axle. The lead axle tends to act as a shunt between the rails and therefore the positioning of the cab signal antenna or inductive coupling is usually done in close proximity to, but in front of the lead axle. This inductively coupled pick-up is an adequate means to receive cab signal information by vehicles which are not powered by frequency varying electric motors. Frequency varying electric drive motors, such as AC propulsion motors used on board locomotives, utilize high current variable frequency electric power. Frequency varying electric drive motors, such as AC locomotive motors, can produce a high level of electromagnetic interference to the cab signal. Cab signal frequencies in the rail current are usually at frequencies of 60 hertz and 100 hertz. The AC drive locomotives use variable frequency, variable amplitude control techniques to drive three-phase traction motors. These propulsion motors draw currents in the order of magnitude of hundreds of amperes. In addition, over the speed range of operation of the locomotive, the frequency range of the propulsion motor current varies over a broad range. At certain speeds and/or propulsion currents the locomotive motor current will have frequency components that will be close to or equal to the cab signal frequency, such as 60 hertz and 100 hertz. Because the locomotive routinely operates over various speed ranges the interference presented by the AC propulsion current can be expected to be encountered at any time during operation, and often enough so as to present a problem to the reliable receipt of AC track signal information.

One solution to avoid the interference between the cab signal system and the AC propulsion system would be to operate the two systems at different frequencies. If the frequency band of the AC propulsion were to be outside the cab signal frequency bands the problem created by the concurrent operation of both systems would be eliminated. However, the present cab signaling frequencies have been utilized for many years and much of the existing equipment operates at those frequency ranges. It would be impractical to change all of the existing cab signal equipment to different frequencies. Similarly, in the AC locomotive propulsion equipment presently utilized, the horsepower and speed ranges demanded by AC traction motors makes the utilization of frequencies between 50 and 100 highly desirable. Therefore it is desirable to have a system which would permit compatibility between existing cab signaling equipment and present AC propulsion motor vehicle drive.

SUMMARY OF THE INVENTION

The invention provides a method to receive the cab signal information from the rails and realize that such cab signal has combined with it a certain component which is related to the electromagnetic interference from the alternating current propulsion motor. In addition to receiving the track cab signals the invention also samples a signal that is characteristic of the electromagnetic interference which is being subjected to the cab signal pickup. Since the cab signal, as received, has an interference component; that component can be removed or substantially reduced by subtracting the sampled signal from the received cab signal. The effect is to cancel the electromagnetic interference component from the sensed track cab signal. In some embodiments it may be desirable to sample a signal which is characteristic of the electromagnetic interference component but has opposite polarity. In that instance the sampled signal can be added to the sensed cab signal, since the polarities of the interference or noise signal are of inversed phase they will tend to cancel. Some of the embodiments of the invention utilize identical pick-up coils positioned relative to the existing cab signal pick-up coils. The sampling devices can consist of a coil or coils positioned on board the locomotive in a location where the sampling device "sees" primarily an interference signal and either a low rail current signal or no rail current signal at all. Flux mapping techniques may be used to determine an optimal location for the sampling device. Because the EMI may vary from vehicle to vehicle, and may be difficult to predict due to the varying metallic structures on-board a rail vehicle, the optimum position for the noise sampling device may be found by adjusting the noise sensor position relative to the vehicle, and/or the cab signal sensing unit. Some of the embodiments utilize a structure which permits the coils to be adjusted after they have been mounted on the vehicle. In some applications the optimum position may be with the noise sensing coil behind the lead axle, while other vehicles may have the optimum position in front of the lead axle generally perpendicular to the cab signal coil. To optimize the positioning or magnitude of the sensed signal in some embodiments it may be desirable to use magnetic shunts between the cores of the respective cab signal sensor and noise sensor. For ease of installation and determining the null at which the noise coils cancel the noise component from the cab signal coil it is desirable to have the two coils mounted so that they may be adjustable for the angle between the cab signal and noise devices.

DESCRIPTION OF SOME EMBODIMENTS

Figure 1A:
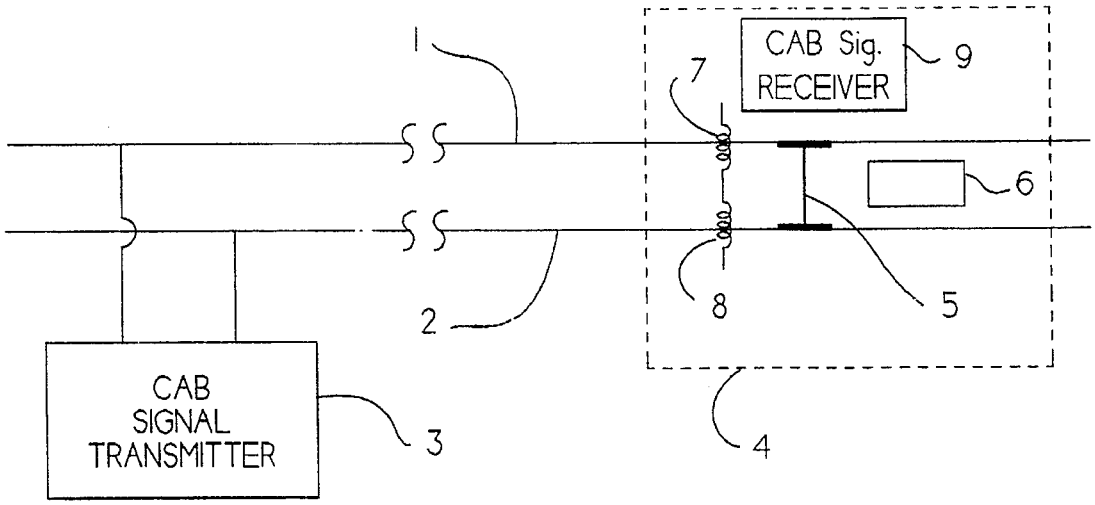
FIG. 1A is a diagrammatic representation of a typical cab signal arrangement.

FIG. 1A shows a typical cab signal system in which a pair of rails 1,2 form a track which will carry a track signal current encoded with information to a vehicle positioned on the track. The vehicle 4, as shown, is moving in a right to left direction in FIG. 1A, and the lead wheel axle assembly 5 is shown. In operation a cab signal transmitter 3 is connected to rails 1 and 2 to feed a cab signal current into the rails. The circuit path is from the cab signal transmitter 3 through rail 1 through the shunt supplied by the wheel and axle assembly 5, and returned to the cab signal transmitter via rail 2. This is a typical track circuit scheme in which the vehicle supplies the shunt between adjacent rails. Usually the majority of track circuit current will go through the lead axle of the vehicle as it advances towards the transmitter. Other portions of the cab signal current may go through loss paths between the rails and a small portion may also go through following wheel and axle assemblies on the vehicle. Therefore it is desirable to place the cab signal receiving coils 7 and 8 in advance of the lead axle, usually 6 to 10 inches above the rail. Additional cab signal receiving apparatus 9 is also located on the vehicle to receive the signal provided by coils 7 and 8 and decode the information from such cab signals for display or utilization on board the vehicle. Most vehicles use electric motors as the primary propulsion drive unit. The motors may be AC or DC, and are usually mounted on the truck assembly to provide a direct gear drive to the vehicle wheel and axle assemblies. In FIG. 1A an AC motor 6 is shown.

Figure 1B:
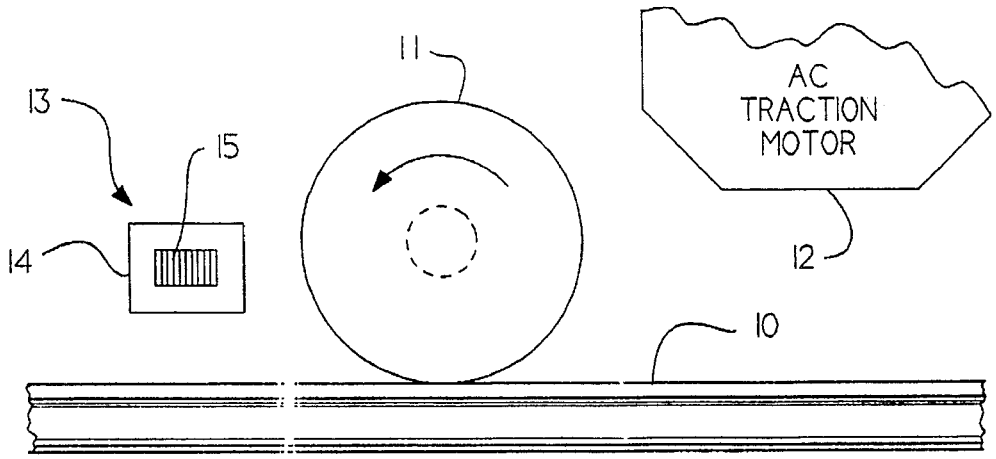
Fig.1b. (Prior Art)
FIG. 1B is a diagrammatic representation showing the arrangement of the cab signal antenna and pick-up coil in relation to the lead axle and rail.

A side view is shown in FIG. 1B which shows the lead axle wheel assembly 11 on rail 10. The cab signal receiving antenna 13 is placed above the rail and in front of the lead axle 11. As such the current beneath the antenna 13 in rail 10 induces an electromagnetic flux in the flux concentrating bars 15 which extend through the cab signal pick-up coil 14. It is desirable to place the cab signal pick-up receiver or antenna, such as 13, in front of the lead axle as the current track cab signal current beneath the pick-up coil is much greater in front of the lead axle than behind the lead axle. This is because the lead axle acts as an electrical shunt and the cab signal current will be directed from the rail 10 into the wheel and axle assembly 11 and electrically connected to the adjacent rail. As a result, the cab signal currents behind the lead axle are zero or significantly less than those in front of the lead axle.

FIG. 1B shows an AC traction motor which is suspended in a well-known manner on the truck or carriage of the rail vehicle and is used to drive the vehicle through well-known propulsion drive mechanical connections. The traction motor and its associated cables and power supply equipment generate a source of high energy variable frequency electromagnetic radiation. This radiation can cause interference with the cab signal reception and may interfere with the antenna pick-up coil 13.

Figure 2:
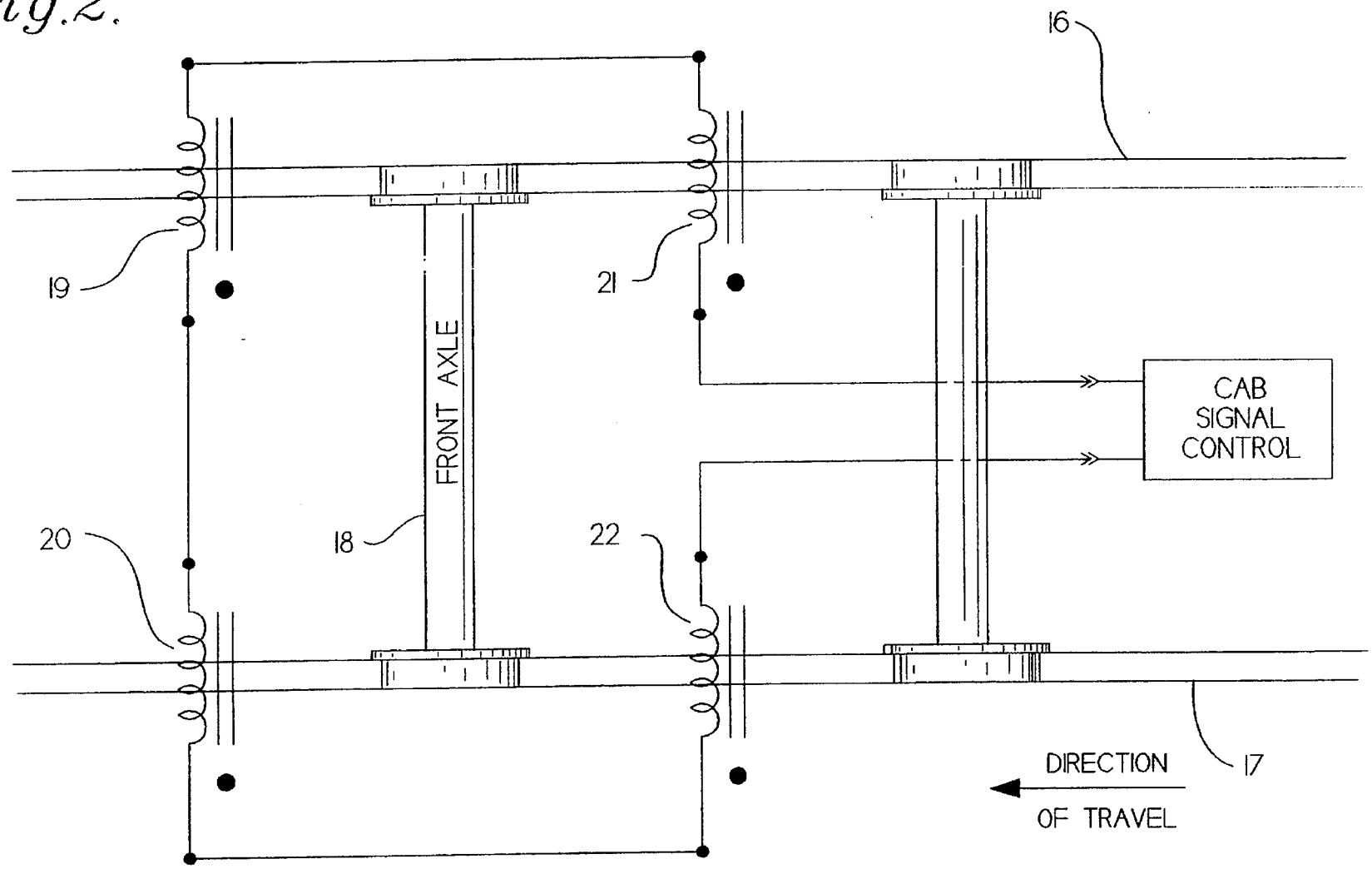
FIG. 2 is a diagrammatic plan view showing an embodiment using two interference sampling coils behind the front axle wheel assembly.

FIG. 2 shows an embodiment of the invention which uses two cab signal receiver pick-up coils 19 and 20, and two interference sampling coils 21 and 22. Lead wheel and axle assembly 18 spans adjacent rails 16 and 17. As can be seen, lead axle 18 completes the electrical circuit between the adjacent rails 16 and 17 providing the shunt path for the cab signal current. The cab signal current would normally be injected into the rails at a remote transmitter from the left side of FIG. 2. The vehicle direction of travel is from right to left so that the lead or front axle 18 provides the shunt current path for the cab signal current. As can be seen, the cab signaling receiver pick-up coils 19 and 20 are mounted in front of the lead axle 18, in an area of rail 16 and 17 where the cab signal current is strongest.

Mounted behind the lead axle are interference sampling coils 21 and 22. In some embodiments it will be preferred that the interference sampling coils are mounted at a similar geometry to the cab signal pick-up coils. The electrical circuit for the four coils 19 through 22 can be seen to have all of the windings connected in series and the output directed to a cab signal front end filter or other cab signal control processing unit. This unit may be of the type that is well-known to those skilled in the art. As will be seen by the polarity of the respective coils 19 through 22, the two cab signal receiving pick-up coils 19 and 20 have their signals added by their series connection to increase the overall strength of the cab signal in the circuit. The respective two interference sampling coils 21 and 22 also have their polarities arranged so that they add or boost the interference signal that they each pick-up. However because both interference sampling coils 21 and 22 have opposite polarities to the respective receiver coils 19 and 20 the interference signal picked-up by coils 21 and 22 will be subtracted from the signals across coils 19 and 20. The signal on coils 19 and 20 both have two components, the desired cab signal component and an undesired interference or noise component. The signals generated across interference sampling coils 21 and 22 because they are positioned behind the front axle do not have the same strong cab signal current imposed thereon, however they still have a substantial electromagnetic interference component. This interference component may be derived primarily from the traction motor and its related power supply. As a result, the interference sampling coils have signals that are identical to or characteristic of the interference component imposed upon receiver pick-up coils 19 and 20. By utilization of the series circuit shown in FIG. 2 and the respective polarities of the pick-up and sampling coils the simple series circuit provides for a means to sum the cab signal components of each of the receiver pick-up coils 19 and 20 and simultaneously subtract (add an opposite polarity) interference signal thereby canceling the interference effect.

An additional advantage of the series circuit connection as shown in FIG. 2 is that should a coil become defective or fail the series circuit then becomes open and a loss of cab signal can be properly evaluated by the on board cab signal control equipment. While the diagram in FIG. 2 shows one possible position for mounting the interference sampling coils, it is to be appreciated that other positions may be equally or more effective in sampling an interference signal which is equal in magnitude to that received by the cab signal pick-up coils. The desire is to pick-up a signal which is generally equal to that interference component received by the cab signal pick-up coils and which may be in an opposing phase so that it may easily be added to the circuit. In this manner the undesired signal in the cab signal pick-up coil will be canceled leaving only the desired signal to be processed by the on board cab signal equipment. Finally it will be desirable to implement the sampling and the cancellation of the interference signal in a vital manner. When using inductive coupling with the sampling device it may be desirable generally to use the sampling coil or coils positioned under the locomotive in a position where it "sees" or senses the interference signal only and not a strong component of the desired cab signal rail current. One such location could be between the first two axles (i.e., behind the lead axle) and mounted relatively close to the floor of the cab. A flux mapping could be used to determine an optimal location for the sampling coil or coils. By monitoring the sampling coils at various positions and comparing them with the signal present from the cab signal receiver pick-up coils, an optimum position can be determined. Wiring the sampling coils in series and varying their position until a zero or null signal appears (with zero track cab signal current) would be one method to determine an optimum position. Other similar methods and other positions may also result in a sampled signal which can be used to cancel the interference component from the cab signal receiving coils. In many embodiments it will be desirable to use sampling coils which are identical to the cab signal coils. In other applications it may be desirable to vary the coil to provide for scaling differences between the respective sampling coils and the receiving coils. As previously stated the series connections allow for a simple shutdown in the event that one of the sampling coils is destroyed. When properly interpreted by the locomotive born cab single equipment the system vitality can be preserved.

Figure 5:
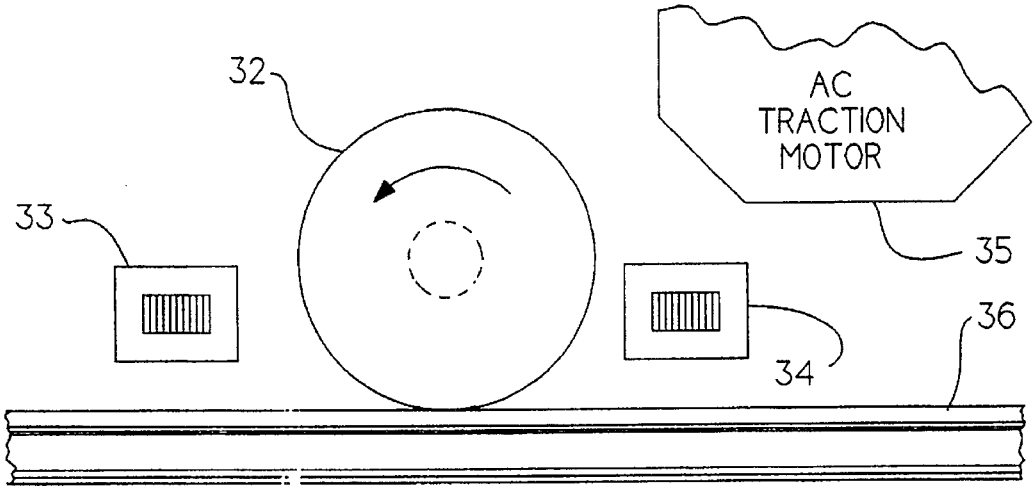
FIG. 5 is a diagrammatic representation showing an embodiment with the position of sampling coils above the rail and behind the lead axle.

FIG. 5 shows a diagrammatic representation of an embodiment similar to that shown in FIG. 2, in a side view. The relative positions of the single receiving coil 33 and the sampling coil 34 can be seen with respect to the lead axle wheel assembly 32. The single receiving coil 33 is in front of the lead axle and spaced above the rail 36. The interference sampling coil 34 is behind the lead wheel/axle assembly 32 and also spaced above the rail. Shown in partial diagrammatic is the AC traction motor 35. While FIG. 5 shows only a single pickup coil 33 and a single sampling coil 34 it is understood that in some embodiments such as that shown in FIG. 2, two signal pick-up coils and two interference sampling coils may be used.

Figure 3:
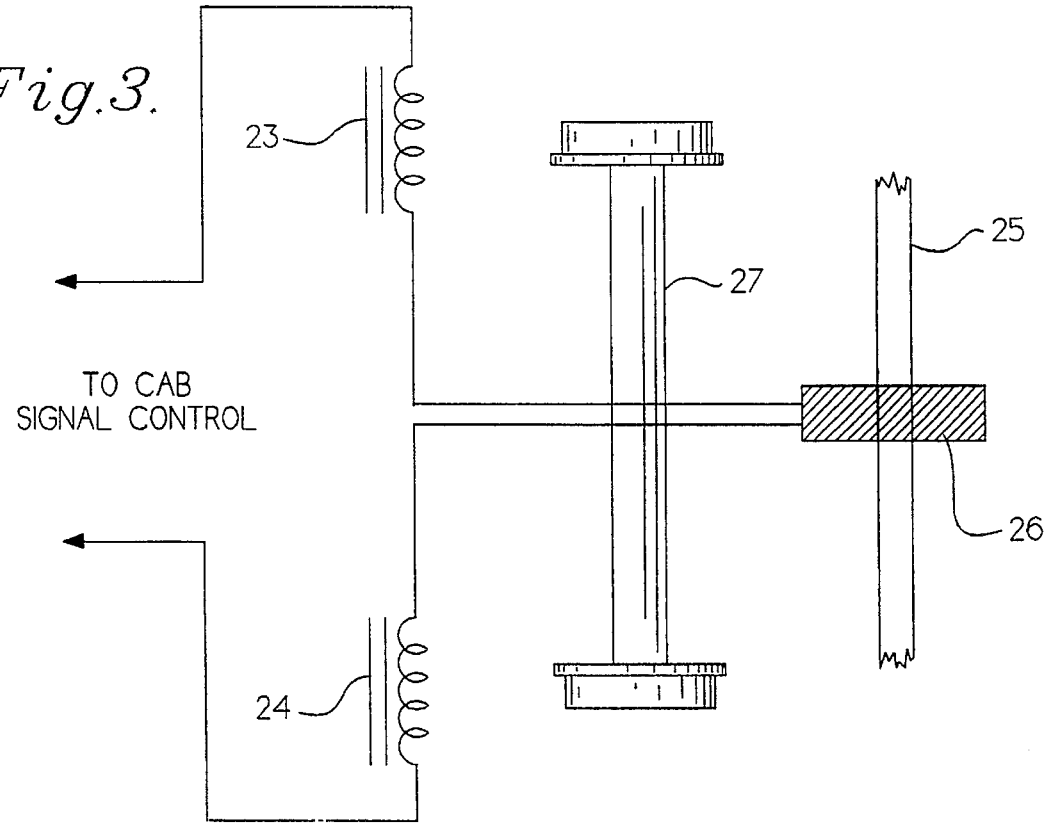
FIG. 3 is a diagrammatic representation of an embodiment showing an interference sampling coil used as a current transformer on the motor power cable.

FIG. 3 shows an embodiment using two signal pick-up coils 23 and 24. These are positioned in front of the lead wheel axle assembly 27. Connected in series with these two pick-up coils is a sampling coil 26 which is used as a current transformer. The current transformer coil 26 is positioned about the motor cable 25 which supplies power to the traction motor. The electromagnetic interference radiating from the motor has a frequency characteristic related to the motor drive current. Therefore motor drive current can be sampled by the current transformer 26 to provide a signal which has the frequency characteristic of the electromagnetic interference. Similar to the embodiment shown in FIG. 2 the interference sampling coil, current transformer 26, is placed in series with the two cab signal pick-up coils 23 and 24. Choosing the polarity and turn ratio of the current transformer 26, a sampling signal of opposite polarity or phase can be derived which cancels the interference component received at coils 23 and 24. Because the cab signal pickup coils 23 and 24 are in series with the sampling coil current transformer 26, the vitality of the circuit is enhanced because a failure such as an open coil in anyone of the components results in a zero output signal which can be properly interpreted by on board cab signal control apparatus.

Figure 4:
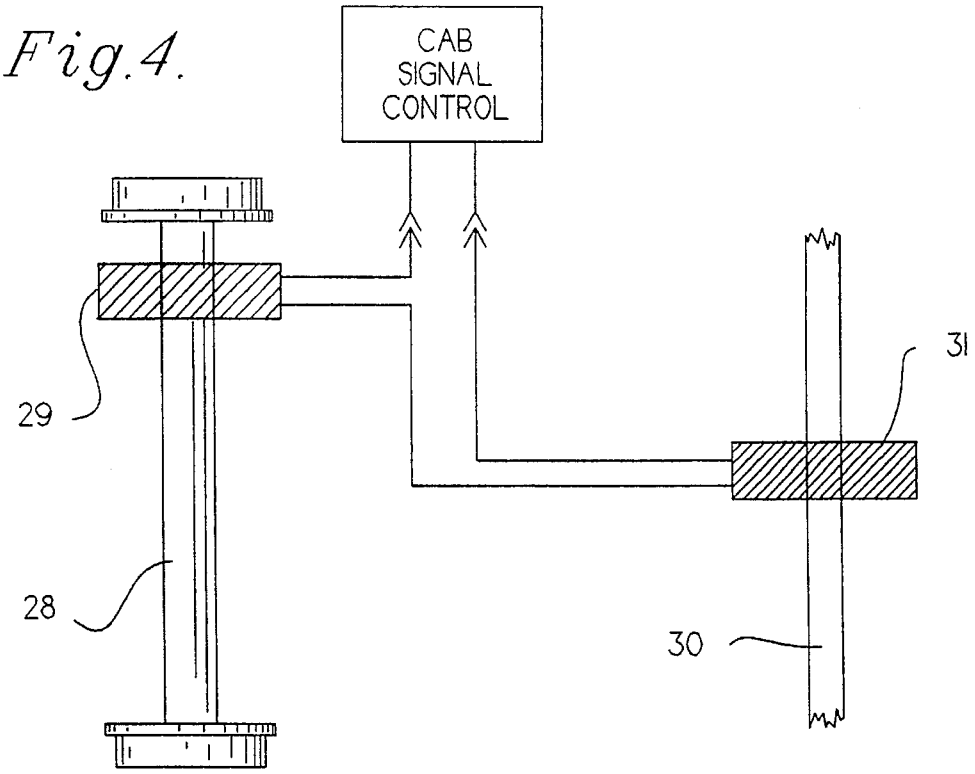
FIG. 4 is a diagrammatic representation showing an embodiment using a current transformer to receive AC cab signals through the lead axle assembly and a sampling coil used as a current transformer on the motor power cables.

The embodiments previously described have used an inductive pickup coil mounted in front of the lead axle, however other means for receiving the cab signal may be used with this invention. FIG. 4 shows a diagrammatic representation in which the cab signal current is sensed by use of a current transformer coil 29 about the lead wheel axle assembly 28. Such cab signal pickup coils are described in U.S. Pat. No. 5,234,184, which is incorporated herein by reference. As shown in FIG. 4 lead wheel and axle assembly 28 has positioned about it a cab signal sensing coil 29 which is in the form of a current transformer. Providing the sampling signal is a sampling coil 31 which is in the form of a current transformer similar to that described with regard to the embodiment shown in FIG. 3. Both the cab signal sensing coil current transformer 29 and the sampling coil 31 are connected in series. The sensing coil current transformer 31 is placed about propulsion motor cable 30 which supplies the electrical power to the drive motor. By adjusting the respective turn ratios of the cab signal sensing coil 29 and the sampling coil current transformer 31, the respective signals of the two coils can be such that the interference component of the coil 29 is canceled by the opposing signal on the sampling coil 31. Because the two coils are connected in series vitality can be provided.

Figure 6:
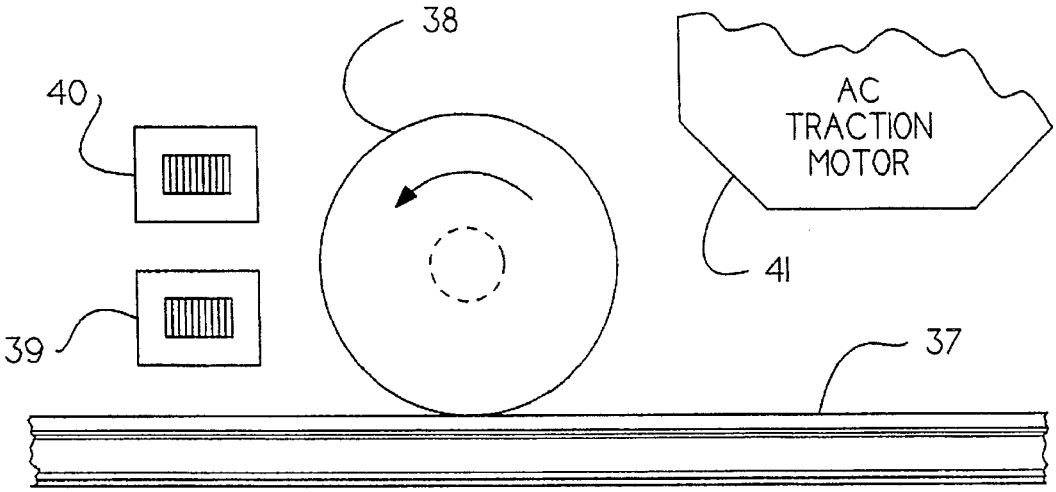
FIG. 6 is a diagrammatic representation showing an embodiment using a sampling coil placed in front of the lead axle and above the cab signal receiving coil.

Another embodiment, shown in FIG. 6, utilizes inductive antennas or pickups for both the cab signal coil and the sampling coil. In this embodiment it may be desirable to utilize identical coils for both the cab signal coils and the sampling coils. The existing well-known pick-up coil/antenna presently utilized in the industry and sold by Union Switch and Signal Inc. (under the designation Track Receiver N396278) may be utilized. This is particularly advantageous since these are existing devices which are well known in the industry and which are available for easy installation and systems repair. Such devices are also compatible with the rugged environment often encountered in the undercarriage location on locomotives and rail vehicles. As shown in FIG. 6 the lead axle wheel assembly 38 rides on rail 37. Propulsion motor 41 is attached to the drive axle in a well known manner. In this embodiment both the cab signal sensing pickup coil 39 and the sampling coil 40 are positioned in advance of the lead wheel and axle assembly 38. As can be understood by viewing FIG. 6, coil 39 is placed above the rail 37 such that the cab signal current inductively couples to the flux concentrator bars in pickup 39. As a result the flux resulting from the track current tends to be maintained in high concentration at and below the pickup coil 39. A substantial reduction in the cab signal flux above the pick-up coil 39 results from the use of the flux concentrator bars and the pick-up coil 39. As a result when the sampling coil 40 is positioned above the cab signal pick-up coil 39 a greatly reduced cab signal current component is generated in the sampling coil 40. However, because the sampling coil 40 is in close proximity to the position of the cab signal pick-up coil 39 the interference component experienced by the pick-up coil 40 can be used to cancel the interference component in the cab signal pick-up 39. The electrical circuit associated with FIG. 6 can be identical to that discussed with regard to FIG. 2, when two cab signal pick-up coils such as 39 are used and two sampling coils such as 40 are used. All four coils can be connected in a series circuit to a cab signal processor unit on board the rail vehicle. The respective polarities of the pick-up coils can, as shown in FIG. 2, be connected so as to boost the respective desired cab signal and cancel the undesired interference component. While some preferred embodiments presently contemplated utilize four coils, two cab signal pickup coils and two sampling coils. Other numbers and combinations of signal sensing coils and sampling coils are included within these embodiments. While these embodiments have been shown with regard to one end of a rail vehicle it will be understood that such devices can be assembled on both ends of rail vehicles so that bi-directional operation is easily achievable.

Figure 7:
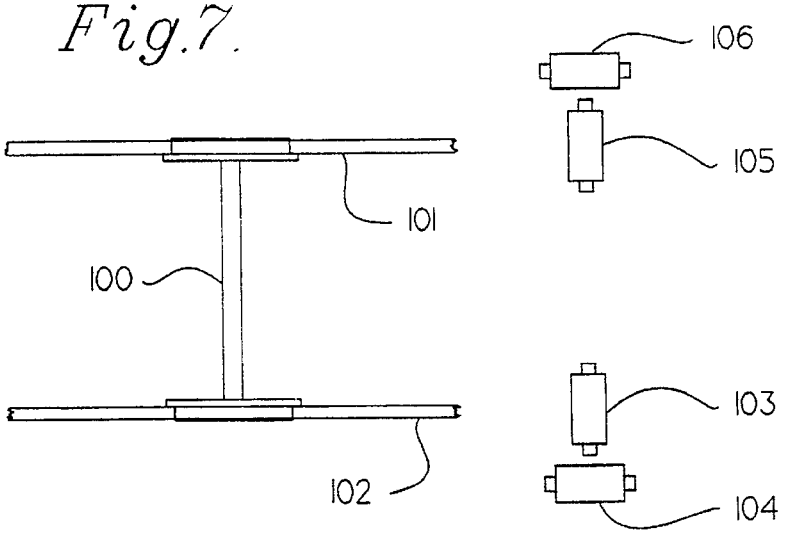
FIG. 7 is a diagrammatic representation showing an embodiment using a sampling coil in front of the lead axle and positioned 90 degrees to the direction of the cab signal receiving coil.

It has been described that a cab signal pick-up coil is positioned above the rail having an axis generally perpendicular to the rail so as to maximize the cab signal from the rail current which it senses. In addition it has been taught that the noise sensing coil is positioned in a location so as to receive the least amount of cab signal component and a noise signal component most representative of the noise received in the cab signal coil. FIG. 7 shows a lead axle 100 carried on rails 101 and 102. A right cab signal sensor 103 is mounted generally above the rail and having a core axis generally perpendicular to the rail which by its very geometry is also parallel to the lead axle 100. As has previously been described, it will generally optimize the magnitude of the cab signal sensed in the cab signal pick-up coil if its core or antenna is mounted generally perpendicular to the rail in which the signal is travelling. Also shown in FIG. 7 is a left cab signal coil mounted as sensor 105, generally parallel to lead axle 100 and perpendicular to rail 101. One way in which to minimize the cab signal component and still experience a high noise component is to mount the noise pick-up coils 104, 106 generally perpendicular to the respective cab signal coils 103, 105. FIG. 7 shows a left noise sensor 104 and a right noise sensor 106 mounted generally perpendicular to the axis of the respective cab signal coils 103 and 105. As shown in FIG. 7, the noise sensing coils 104 and 106 are shown mounted perpendicular to and generally intersecting the axis of the respective coils of the cab signal pick-up sensors 103 and 105. As described previously, the noise sensing coils may be mounted in any plane generally parallel to the rails 101 and 102, which is also a plane perpendicular to axle 100.

Figure 8:
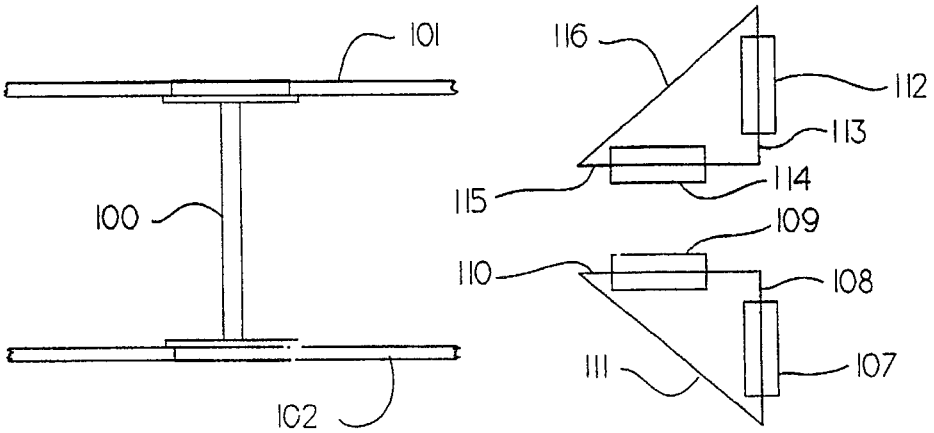
FIG. 8 is a diagrammatic representation showing the sampling coils and receiving coils with their cores connected to form a triangular arrangement by use of a shunt.

Referring to FIG. 8, there is shown another embodiment of the present invention which utilizes a right cab signal, coil 107 positioned generally perpendicular to the rail 102, i.e., parallel to the lead axle 100. Coil 107 is mounted on a right cab signal core 108. The cab signal cores or antenna and the sampling or noise cores can be either a solid magnetic core or a transformer type laminated magnetic core or other magnetic conducting material. These are well-known to those skilled in the art. FIG. 8 also shows a right noise coil 109 which is mounted having its core axis generally perpendicular to the cab signal coil 107. The noise coil 109 is mounted to a right noise core 110. The core 110 is also perpendicular to the core 108, and is perpendicular to the lead axle 100. In this embodiment, cores 110 and 108 may be mechanically and/or electrically connected together at their intersection. This arrangement provides certain magnetic linkages between the two coils and may also be used to provide for an integral mechanical mounting arrangement. To further assist in the mounting, a right link 111 connects cores 110 and 108. This provides for a means to mount and maintain the desired angular differences between the respective cab signal pick-up coil 107 and the noise coil 109. Right link 111 may be sized so that the triangular formed by 111, 110, and 108 is a right triangle. To further tune the system it may be desirable to have link 111 adjustable or in fact having a specific preselected length which provides for the optimum angle between coils 107 and 109. One such angle, which may in some applications meet the desired high noise pick-up and reduced cab signal pick-up in the noise coil 109, is 90 degrees. Other angles may provide a better signal to noise ratio between the respective coils 107 and 109 in other vehicle applications.

In some instances it may be desirable that the connecting link, such as 111, is made of a non-magnetic conducting material, such as fiberglass. In such systems using a non-metallic link 111, the connecting link 111 can be used to both provide mounting for the other coils and as a means to maintain the desired angle or find the desired angle between the cab signal coil 107 and the noise coil 109.

FIG. 8 also shows an arrangement on the left side of the rail vehicle which may be either a locomotive or a passenger transit vehicle in which the left cab signal coil 112 is similarly connected to a left noise coil 114 by means of the left cab signal core 113 being connected to the left noise sampling core 115. As previously described, these respective coils are located generally at 90 degrees to each other, and the noise coil 114 is generally parallel to the rail and is perpendicular to the lead axle 100. Left connecting link 116 functions similarly to the right connecting link 111. As shown in FIG. 8, the left assembly, including coils 112 and 114, may in fact be identical to the right assembly which includes coils 109 and 107. In such a way the right and left assemblies can be identical and all parts therein can be identical, reducing the cost of the devices and the inventory of right and left hand assemblies. Such assembly may be bolted or otherwise attached to the underframe of the rail vehicle.

Figure 9:
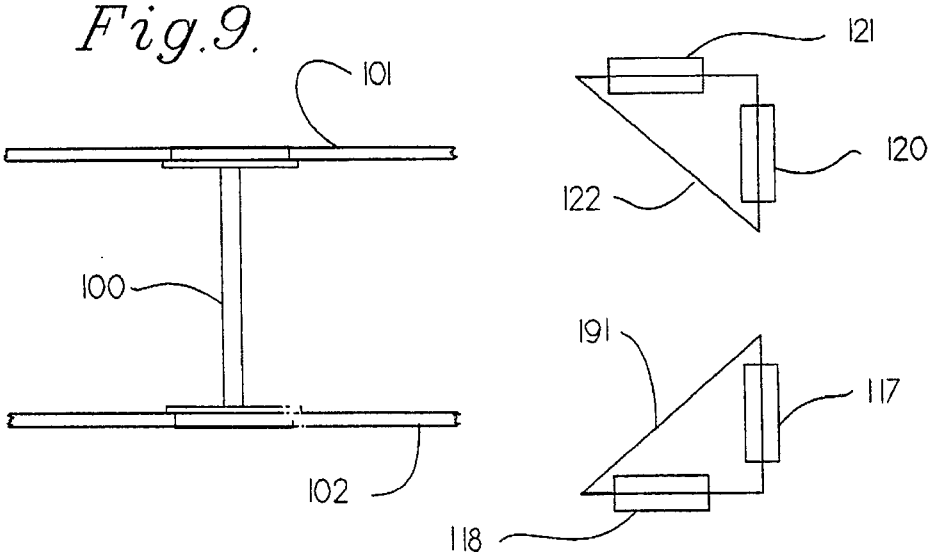
FIG. 9 is a diagrammatic representation similar to FIG. 8 showing a triangular arrangement reversed from that shown in FIG. 8.

Referring to FIG. 9 there is shown an arrangement similar to that shown in FIG. 8 in which the cab signal coils 117 and 120 are mounted generally perpendicular to the rail while the axis of the noise coils 118 and 121 are located generally parallel to the rail 100, i.e., perpendicular to the lead axle 100. However, in this embodiment, the noise coils 121 and 118 are located outwardly of the respective cab signal coils 120 and 117. Right and left connecting links 118 and 122 function as described with regard to connecting links 111 and 116. The embodiment in FIG. 9 may be utilized where the mechanically structure of the locomotive or vehicle does not permit easy access to the area of the noise pick-up coils 109, 114 as in the inward mounting arrangement shown in FIG. 8. In addition, in determining whether an arrangement such as those shown in FIG. 8 or in FIG. 9 should be utilized, the position of the respective noise coils in which the noise signal most closely matches that of the undesired noise which is picked-up in the respective cab signal coil should be chosen. As described earlier, this position may be determined by moving the noise pick-up coils slowly within the EMI field generated by the noise source, such as the traction motors, until a null signal is received from the sum of the noise coil and the cab signal pick-up coil.

Figure 10:
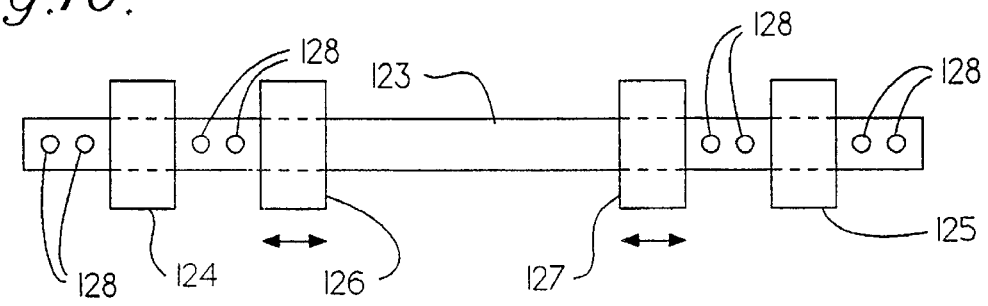
FIG. 10 is a diagrammatic representation of a device having a single core in which the noise and sampling coils can be adjustably tuned.

FIG. 10 shows an arrangement in which the noise pick-up coils may be easily moved along a common core. In such a manner, the system can be tuned to the specific vehicle on which it operates. This is especially advantageous where the noise EMI will vary from one vehicle to another. FIG. 10 shows a single core 123 which has mounted thereon a left cab signal coil 124, a right cab signal coil 125, a left noise coil 126, and a right noise coil 127. In operation the core 123 is attached to the vehicle by any of respective mounting holes 128. Other means, of course, can be used to mount the core beneath the locomotive and adjacent to the respective rails. In operation the cab signal coils 124 and 125 are positioned generally over the rail, and in fact the core will now be mounted generally perpendicular to the rail, i.e., parallel to the axle of the lead vehicle. Noise coils 126 and 127 can then be moved along the core 123 until an optimum position is found. When a null occurs the coils 126 and 127 can then be fixed in that position. A further advantage of the common core shown in FIG. 10 is that the cab signal coils 124 and 125 may also be moved laterally to attain alignment generally perpendicular with regard to the rail. In practice, it may be desirable that the core 123 be of circular cross-section so as to provide for easy assembly and movement of the respective coils 124 through 127. However, it is also contemplated that the core 123 may be of rectangular cross-section and may in fact be a laminated rectangular cross-section in which the coils 124 through 127 are also permitted to be slidably engageable on the core 123. The final position of the respective coils 124 through 127 on the core 123 at their tuned positions may be made by providing clamps to retain the coils from lateral movement, providing bolt arrangements, or they may be bonded to the core 123 by epoxy or other compound.

If it is determined that a specific position of the cab signal and noise coils is optimum for a given vehicle, and if it is known that a number of vehicles having similar EMI patterns will be utilized, the assemblies shown in FIGS. 8–13 may be manufactured with one or all of the coils fixed to the core, such that the core merely needs to be mounted in the vehicle having a similar EMI pattern.

Figure 11:
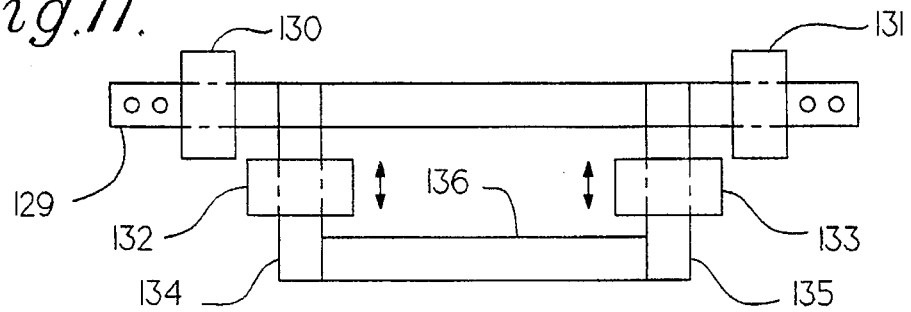
FIG. 11 is a diagrammatic representation showing the cab signal sampling coils mounted on a common core with respective noise coils mounted adjustably at 90 degrees to the sampling coils.

FIG. 11 shows an arrangement having a core 129 with a left cab signal coil 130 and a right cab signal coil 131 mounted thereon. In addition two noise coils, 132 and 133 are mounted at generally right angles to the axis of the cab signal coils. As such the noise coils 132 and 133 are mounted having their respective core axes generally parallel to the rail, which coils are also perpendicular to the lead axle (not shown). In the arrangement of FIG. 11, the left noise coil 132 and the right noise coil 133 are mounted on respective left noise core 134 and right noise core 135. Coils 132 and 133 are mounted so as to be adjustable on the respective cores 134 and 135. This adjustment permits tuning the noise coils to optimize the pick-up of the EMI signal and provide the best signal to noise ratio with regard to the respective cab signal coils. The embodiment shown in FIG. 11 also shows a shunt member 136. This shunt member 136 may be either purely a mechanical device which provides support for the respective noise pick-up coils 132 and 133. However, it may be desirable in some applications that the shunt 136 be a magnetic shunt which provides for a variable reluctance path which can be used to tune the circuit and permit the noise and cab signal coils to be of the same general construction. Such shunt can be used to create an alternative path for the magnetic flux lines to better balance the noise components. By providing a plurality of bolt holes along the length of the cores 129 and 136 so that the coils 132 and 133 may be moved into other planes parallel to the rail, i.e., perpendicular to the lead axle, until an optimum noise signal is detected. To maintain the perpendicular arrangement or provide for other angular arrangements between the respective axes of the coils 132, 133, and 130, 131, the link 136 may also be made adjustable. The length or the effective length of the link 136 may be adjusted by respectively connecting the noise cores 134 and 135 to alternate positions on the link 136.

Figure 12:
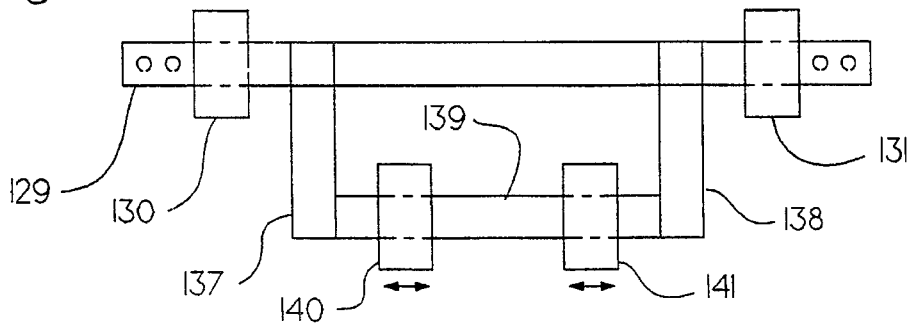
FIG. 12 is a diagrammatic representation similar to FIG. 11 with the noise sampling coils mounted generally parallel to the sampling coils.

FIG. 12 shows an embodiment having a core 129 which is mounted generally parallel to the lead axle, i.e., perpendicular to the rails. Cab signal coils 130 and 131 are also mounted on the core 129 so as to be positioned generally above and perpendicular to the rails. A left shunt link 137 and a right shunt link 138 are attached to the core 129. Two noise coils 140 and 141 are connected between the left and right shunt link on a noise core 139. Noise coils 140 and 141 may be adjusted along the longitudinal axis of the core 139. In this way the optimum position for the noise coils can be achieved. As previously described the shunt paths through the noise core 139 and the center portion of 129 can be used to tune the reluctance of the noise circuit with respect to the cab signal magnetic circuit in core 129, coil 130, coil 131.

Figure 13:
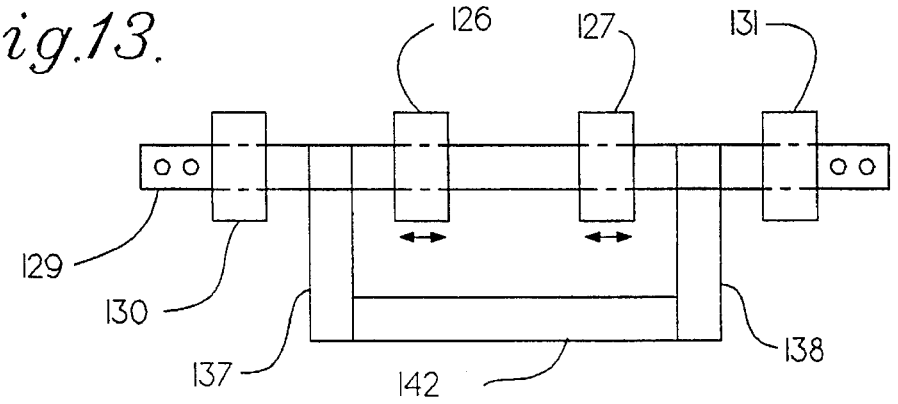
FIG. 13 is a diagrammatic representation showing the sampling and noise coils mounted similar to FIG. 10 and also including a shunt path.

FIG. 13 shows a core 129 having cab signal coils 130 and 131 mounted thereon. This core is similar to those previously described and functions similarly. In addition, however, two noise coils 126 and 127 are mounted on core 129. The noise coils 126 and 127 are mounted so as to be adjustable along the axis of core 129. As such they can be "tuned" to the specific noise, EMI, on the vehicle. Because the noise signals and cab signal may be of varying orders of magnitude, it may be desirable to provide a magnetic shunting path through left shunt link 137, center shunt link 142 and right shunt link 138. This provides the ability to tune the reluctance of the respective magnetic circuits for the cab signal and the noise coils so as to optimize the signal to noise ratios or permit the utilization of identical coils for both cab signal pick-up purposes and noise pick-up purposes.

While the embodiments shown in FIGS. 11 through 13 have shown the use of two separate noise pick-up coils, it is contemplated that in some applications it may be adequate and in fact desirable to use a single noise pick-up coil in lieu of the two shown. In applications where only a single noise pick-up coil is used, it will be connected generally in series with the respective cab signal coils so as to cancel the noise component from such cab signal coils.

Figure 14:
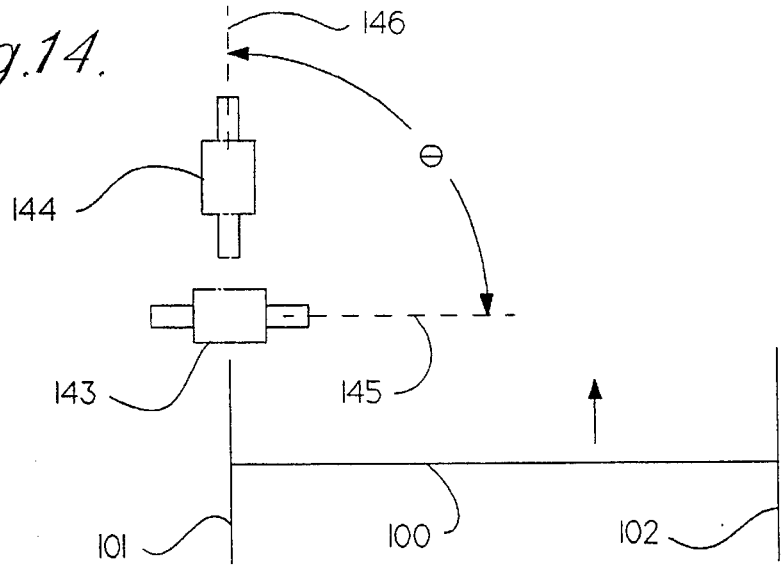
FIG. 14 is a diagrammatic representation showing the angular arrangement between cab signal sampling coil and a noise coil.

Referring to FIG. 14, there is shown a diagrammatic representation of a mounting arrangement in which a cab signal coil 143 is mounted having the axis of its core generally parallel to the lead axle 100 and generally perpendicular to the rail 101. Also shown is a noise coil 144 having the axis of its core generally parallel to the rail, i.e., perpendicular to the lead axle 100. As such, the angle between the core axis of the cab signal pick-up coil 143 and the axis of noise coil 144 is shown as θ. The axis of the cab signal coil 143 is shown as reference line 145. The axis of the noise coil is shown as line 146. The angle between the respective axis in this plane is shown as θ. The axis generally corresponds to the axis of the respective core of the respective coil or sensor. In some embodiments it has been shown where the optimum signal for noise rejection will be obtained where the angle θ is generally 90 degrees. Other embodiments have been discussed in which the cab signal coils and the noise coils are mounted in generally parallel planes, θ equals 0 degrees. With regard to the optimum angle θ, the angle will in most instances be specific to the vehicle on which the sensors are mounted. This is due to the fact that railway vehicles may have an erratic EMI pattern, and in fact because of the large amounts of steel and other magnetically conducting materials the EMI radiation patterns will vary from vehicle to vehicle. This invention contemplates that the noise sensors will be mounted at an angle θ which provides the optimum signal to noise ratio between the respective sensors. Many of the embodiments shown have used adjustable mounting coils because it is believed that the EMI patterns may vary from one vehicle to another such that it will be desirable to tune or optimize each coil on each application. However, this invention also contemplates that some vehicles, because of their similarity, will be able to use identical mounting arrangements. In those cases, the sensors need not be adjustable as shown, but can in fact be at a predetermined angle θ, which best optimizes the signal to noise ratio for that vehicle.

Figure 15:
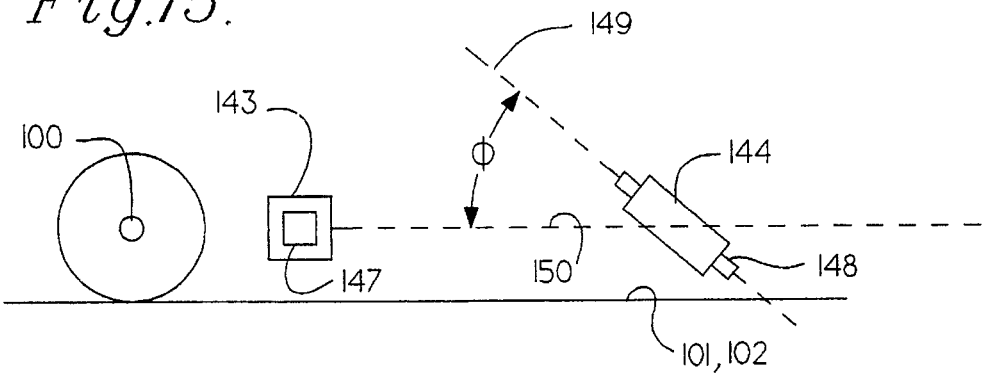
FIG. 15 is a diagrammatic representation in a plane generally perpendicular to that shown in FIG. 14 showing the angular relationship between the sampling and noise coils.
Figure 16:
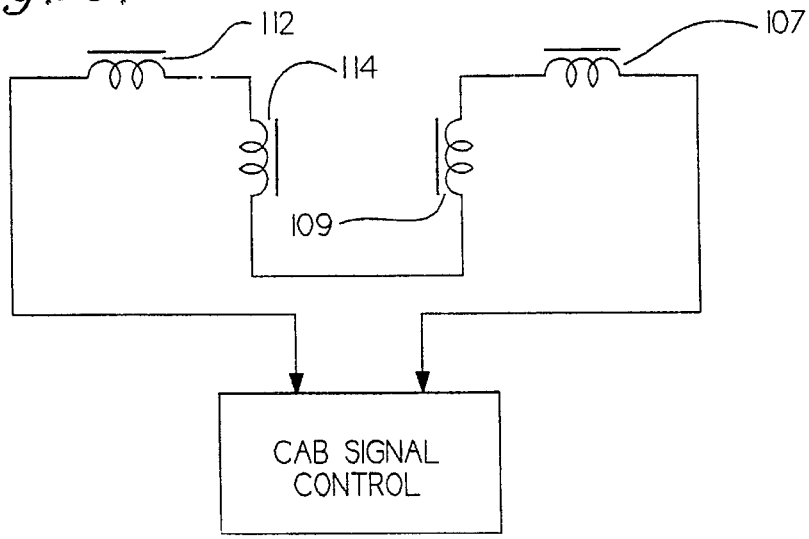
FIG. 16 is an electrical circuit diagram showing an arrangement in which the noise and sampling coils are arranged in series so as to cancel the effects of the EMI as seen by a cab signal control unit.

Similarly, FIG. 15 shows the relationship of the sensors in a plane perpendicular to that shown in FIG. 14. The cab signal coil 143 is shown having a core 147, and it is mounted in a plane having the coil axis generally parallel to the axle 100 and perpendicular to the rails 101 or 102. A noise coil 144 is mounted above the rails 101, 102. The core 148 of the noise coil 144 is shown having an axis 149. The position of the coil 144 can vary such that the angle ø with respect to the plane of the rails 101, 102 can be changed. As shown in some embodiments, the noise coil 144 is mounted in a plane parallel to the rails, and intersecting the axis of the AC cab signal coil 143, therefore ø equals 0 degrees. This may in fact be an optimum location for many applications. However, it is contemplated within the scope of this invention that the noise coil may be positioned at any angle of ø where the previously discussed optimum noise to signal ratio is determined. Again, this angle may be determined using a null test wherein the noise components of the cab signal coil and the output of the noise pick-up signal are compared, subtracting one from the other, until a null or zero occurs. It is contemplated that both the angles ø and θ may be varied to where such null occurs. It may also be that for a number of applications, depending on the EMI patterns of the respective vehicle, that it will be desirable for the angle ø to be zero. Some consideration in picking a proper angle ø should be given to the structural arrangement of the respective vehicle such that there is adequate room for mounting the noise coil.

While the figures have shown various angles ø and θ, it is understood as explained initially, the noise coils are positioned to cancel or null the noise portion of the cab signal sensors current. This can include varying ø and θ, along with the orientation in a plane perpendicular to both ø and θ. Because of the crowded environment beneath the locomotive some variation is expected from one vehicle installation to another. However, proper angular relationships will be achieved by utilization of the apparatus an methods of this invention as described to obtain the optimum position for most effective cancellation of the undesired noise.

While some very specific details have been given with regard to the embodiment shown, it is understood that those skilled in the art will be able to easily modify the techniques of the invention described herein to produce other embodiments which are particularly adapted to specific vehicle or railway conditions. All such other embodiments are included within the scope of the following claims:

I claim:

1. A cab signal receiving apparatus mounted on board a railway vehicle propelled on rail tracks by an electric drive motor and having a lead wheel/axle assembly, such receiving apparatus comprising:

signal receiving means mounted on such railway vehicle for sensing track current and providing a sensed signal;

said sensed signal having a cab signal component and an interference component;

sampling means for providing a sampled signal having the characteristic of electromagnetic interference subjected to said signal receiving means by the magnetic field of such electric motor;

means for subtracting said sampled signal from said sensed signal such that said interference component is reduced;

said receiving means including at least one receiver coil arranged to inductively couple to such track current;

said sampling means including at least one sampling coil arranged to pick-up electromagnetic interference characteristic of the electromagnetic interference subjected to said at least one receiver coil;

said at least on receiving coil including a plurality of receiving coils, and said at least one sampling coil including a sampling coil for each of said receiving coils, arranged with a respective one of said receiving coils to pick-up electromagnetic interference characteristic of said respective one of said receiving coils; and said sampling coils and said receiving coils are mounted on a single core.

2. The invention of claim 1 wherein said sampling coils are mounted on said single core to be adjustable along said core.

3. The invention of claim 1 wherein said sampling coils are mounted generally perpendicular to said receiving coils and mounted generally perpendicular to such lead wheel/axle assembly.

4. The invention of claim 1 further including a magnetic shunt link providing a shunt path around at least a portion of said single core.

5. The invention of claim 3 wherein said sampling coils are mounted on a shunt link in a magnetic shunt path from a portion of said single core.

6. The invention of claim 5 wherein said sampling coils are slidably adjustable on said shunt link in a direction generally perpendicular to such lead wheel/axle assembly.

7. A cab signal receiving apparatus mounted on board a railway vehicle propelled on rail tracks by an electric drive motor and having a lead wheel/axle assembly, such receiving apparatus comprising:

signal receiving means mounted on such railway vehicle for sensing track current and providing a sensed signal;

said sensed signal having a cab signal component and an interference component;

sampling means for providing a sampled signal having the characteristic of electromagnetic interference subjected to said signal receiving means by the magnetic field of such electric motor;

means for subtracting said sampled signal from said sensed signal such that said interference component is reduced;

said receiving means including at least one receiver coil arranged to inductively couple to such track current;

said sampling means including at least one sampling coil arranged to pick-up electromagnetic interference characteristic of the electromagnetic interference subjected to said at least one receiver coil;

said at least one receiving coil including a plurality of receiving coils, and said at least one sampling coil including a sampling coil for each of said receiving coils, arranged with a respective one of said receiving coils to pick-up electromagnetic interference characteristic of said respective one of said receiving coils;

said sampling coils and said receiving coils are mounted on a single core; and at least one of said receiving coils is mounted generally perpendicular to at least one of said sampling coils.

8. A cab signal receiving apparatus mounted on board a railway vehicle propelled on rail tracks by an electric drive motor and having a lead wheel/axle assembly, such receiving apparatus comprising:

signal receiving means mounted on such railway vehicle for sensing track current and providing a sensed signal;

said sensed signal having a cab signal component and an interference component;

sampling means for providing a sampled signal having the characteristic of electromagnetic interference subjected to said signal receiving means by the magnetic field of such electric motor;

means for subtracting said sampled signal from said sensed signal such that said interference component is reduced;

said receiving means including at least one receiver coil arranged to inductively couple to such track current;

said sampling means including at least one sampling coil arranged to pick-up electromagnetic interference characteristic of the electromagnetic interference subjected to said at least one receiver coil;

said at least one receiving coil including a plurality of receiving coils, and said at least one sampling coil including a sampling coil for each of said receiving coils, arranged with a respective one of said receiving coils to pick-up electromagnetic interference characteristic of said respective one of said respective coils;

said sampling coils and said receiving coils are mounted on a single core; and at least one of said sampling coil is mounted parallel to said lead wheel/axle assembly and said at least one of said sampling coils is mounted generally perpendicular to such lead wheel/axle assembly for sensing electromagnetic interference.

9. A cab signal receiving apparatus mounted on board a railway vehicle propelled on rail tracks by an electric drive motor and having a lead wheel/axle assembly, such receiving apparatus comprising:

signal receiving means mounted on such railway vehicle for sensing track current and providing a sensed signal;

said sensed signal having a cab signal component and an interference component;

sampling means for providing a sampled signal having the characteristic of electromagnetic interference subjected to said signal receiving means by the magnetic field of such electric motor;

means for subtracting said sampled signal from said sensed signal such that said interference component is reduced;

said receiving means including at least one receiver coil arranged to inductively couple to such track current;

said sampling means including at least one sampling coil arranged to pick-up electromagnetic interference characteristic of the electromagnetic interference subjected to said at least one receiver coil;

said at least one receiving coil including a plurality of receiving coils, and said at least one sampling coil including a sampling coil for each of said receiving coils, arranged with a respective one of said receiving coils to pick-up electromagnetic interference characteristic of said respective one of said receiving coils;

said sampling coils and said receiving coils are mounted on a single core; and each said sampling coil is mounted generally perpendicular to a respective one of said receiving coils and the respective ones of said sampling coils and said receiving coils have respective cores connected together at a generally 90 degree angle.

10. The invention of claim 9 wherein the respective ones of said sampling cores and said receiving cores are connected to a link member thereby forming a triangular arrangement.

11. The invention of claim 10 wherein said link member is magnetic shunt member.

12. A cab signal receiving apparatus mounted on board a railway vehicle propelled on rail tracks by an electric drive motor and having a lead wheel/axle assembly, such receiving apparatus comprising:

signal receiving means mounted on such railway vehicle for sensing track current and providing a sensed signal;

said sensed signal having a cab signal component and an interference component;

sampling means for providing a sampled signal having the characteristic of electromagnetic interference subjected to said signal receiving means by the magnetic field of such electric motor;

means for subtracting said sampled signal from said sensed signal such that said interference component is reduced;

said receiving means includes two receiving coils mounted generally perpendicular to said tracks; and said sampling means includes two sampling coils mounted so as to be adjustable relative to the axis of said receiving coils.

13. The invention of claim 12 wherein said sampling coils have angles which are adjustable from a plane of said rails.

14. The invention of claim 13 wherein the angles between said sampling coils and receiving coils are adjustable to generally equal 90 degrees; and the angle between at least one said sampling coil and the plane of said rails is generally equal to 0 degrees.

15. A cab signal receiving apparatus mounted on board a railway vehicle propelled on rail tracks by an electric drive motor and having a lead wheel/axle assembly, such receiving apparatus comprising:

signal receiving means mounted on such railway vehicle for sensing track current and providing a sensed signal;

said sensed signal having a cab signal component and an interference component;

sampling means for providing a sampled signal having the characteristic of electromagnetic interference subjected to said signal receiving means by the magnetic field of such electric motor;

means for subtracting said sampled signal from said sensed signal such that said interference component is reduced;

said signal receiving means includes two receiving coils mounted in front of such lead wheel/axle assembly;

said sampling means includes at least two sampling coils mounted in front of such lead wheel/axle assembly;

said receiving coils mounted generally parallel to such lead wheel/axle assembly; and said sampling coils mounted generally perpendicular to said lead wheel/axle assembly.

16. The invention of claim 15 wherein said receiving coils and sampling coils are connected electrically in a series arrangement with respective opposite polarities such that cab signal components sensed thereby are added together while electromagnetic interference signals sensed thereby are cancelled.

17. A method of receiving railway cab signals on board a railway vehicle having a lead wheel/axle assembly and propelled by an electric drive motor comprising:

sensing a track signal current and providing a sensed signal having a cab signal component and an interference component;

sampling electromagnetic radiation on board such vehicle at a location having an interference characteristic of said interference component;

providing a sampled signal with said interference characteristic;

subtracting said sampled signal from said sensed signal;

said sensing is at a position in front of such lead wheel/axle assembly;

said sampling is taken at a position in front of such lead wheel/axle assembly;

said sensing is provided by at least one receiving coil mounted generally parallel to said lead wheel/axle assembly; and wherein said sampling is provided by at least one sampling coil mounted generally perpendicular to such lead wheel/axle assembly.

18. A method of receiving railway cab signals on board a railway vehicle having a lead wheel/axle assembly and propelled by an electric drive motor comprising:

sensing a track signal current and providing a sensed signal having a cab signal component and an interference component;

sampling electromagnetic radiation on board such vehicle at a location having an interference characteristic of said interference component;

providing a sampled signal with said interference characteristic;

subtracting said sampled signal from said sensed signal;

said sensed signal is provided by a pair of receiving pick-up coils mounted in front of the lead axle and said receiving pick-up coils include cores oriented generally parallel to such lead wheel/axle assembly; and said sampling electromagnetic radiation is provided by a pair of noise coils mounted in front of said lead wheel/axle assembly and said noise coils include cores oriented generally perpendicular to such lead wheel/axle assembly.

19. The method of receiving railway cab signals on board a railway vehicle of claim 18 wherein the respective cores of respective pairs of said receiving and noise coils are connected together at generally a right angle.

20. The method of receiving railway cab signals on board a railway vehicle of claim 19 wherein the respective ends of the cores of said receiving and noise coils are connected together by a magnetic shunt.

* * * * *

UNITED STATES PATENT AND TRADEMARK OFFICE

CERTIFICATE OF CORRECTION

PATENT NO. : 5,501,417
DATED : March 26, 1996
INVENTOR(S) : RONALD R. CAPAN

It is certified that error appears in the above-indentified patent and that said Letters Patent is hereby corrected as shown below:

On title page,

At [56] References Cited, change "2,000,266" to --2,000,166--.

Column 12, line 38, claim 1, change "on" to --one--.

Column 13, line 59, claim 8, change "coil" to --coils--.

Signed and Sealed this

Thirty-first Day of December, 1996

*Attest:*

*Attesting Officer*

Bruce Lehman

BRUCE LEHMAN

*Commissioner of Patents and Trademarks*